United States Patent [19]

Wulf

[11] 4,352,969

[45] Oct. 5, 1982

[54] INDUCTIVELY HEATED ROTARY RETORT HEAT TREATING FURNACE

[75] Inventor: Karl A. Wulf, Rockford, Ill.

[73] Assignee: Alco Standard Corporation, Valley Forge, Pa.

[21] Appl. No.: 207,211

[22] Filed: Nov. 17, 1980

[51] Int. Cl.[3] ..... H05B 6/10

[52] U.S. Cl. ..... 219/10.75; 219/10.57; 219/10.69; 219/10.77; 422/202; 422/186; 422/307; 373/144; 373/146

[58] Field of Search ..... 219/10.57, 10.77, 10.75, 219/10.79, 10.69, 121 PL; 13/26, 32, 33; 422/186, 202, 209, 213, 307

[56] References Cited

U.S. PATENT DOCUMENTS

| | | | |
|---|---|---|---|
| 2,904,664 | 9/1959 | Rothacker | 219/10.77 |
| 3,190,997 | 6/1965 | Rothnacker | 13/26 |
| 3,226,465 | 12/1965 | Downing et al. | 13/26 |
| 4,039,794 | 8/1977 | Kasper | 219/10.49 |
| 4,070,542 | 1/1978 | Miles et al. | 13/26 |
| 4,221,762 | 9/1980 | Andrjushin et al. | 13/26 |

OTHER PUBLICATIONS

"Rotary Retort" by Heat Technology Company Selas.

*Primary Examiner*—M. H. Paschall

*Attorney, Agent, or Firm*—Leydig, Voit, Osann, Mayer & Holt, Ltd.

[57] ABSTRACT

Workpieces are heat treated as they are advanced through and tumbled within a rotary retort. The retort is heated by electrical current which is inductively induced by coils disposed in surrounding relationship with the retort. A flared distributor on the exit end of the retort causes the workpiece to dribble continuously out of the retort.

6 Claims, 4 Drawing Figures

INDUCTIVELY HEATED ROTARY RETORT HEAT TREATING FURNACE

BACKGROUND OF THE INVENTION

This invention relates generally to apparatus for heat treating workpieces and, more particularly, to a rotary retort heat treating furnace. In such a furnace, loose workpieces are loaded into a drum-like retort mounted to rotate about a horizontal axis and adapted to be heated to high temperatures. As the retort is rotated, means such as a helical flight within the retort advance the workpieces gradually through the retort while causing the workpieces to tumble continuously during their advance so as to fully expose all portions of the workpieces to heat and to a treating gas. The workpieces usually are discharged from the retort into a quench tank of oil or water.

Most commercially available heat treating retorts are heated by gas-fired burners. Heat is generated at the outer surface of the retort and then is transferred by conduction through the retort wall to the workpieces. In order to promote efficient thermal conduction and to reduce thermal stress in the retort, it is necessary to make the retort of relatively thin-walled construction in an effort to decrease the temperature gradient between the inner and outer sides of the retort. By virtue of its thin-walled construction, a retort of any substantial length tends to sag and flex severely under the weight of the tumbling workpieces and ultimately will fail as a result of fatigue. Because of the limitations on the practical length of the retort, it is necessary to make the retort comparatively large in diameter in order to enable the retort to achieve an adequate production rate.

SUMMARY OF THE INVENTION

The general aim of the present invention is to provide a new and improved rotary retort heat treating furnace in which the retort is inductively heated by inducing electrical current to flow in the retort itself. As a result of such heating, there is virtually no temperature differential between the outer and inner surfaces of the retort. Because it is not necessary to overheat the outer surface of the retort to as high a temperature in order to heat the workpieces to a given temperature, thermal stress within the retort is relatively low, and a comparatively thick-walled and small diameter retort can be used to achieve a high production rate.

Another object of the invention is to provide an inductively heated retort having a plurality of individually controllable temperature zones for optimizing the heat treating process and also to provide a retort whose initial zone is capable of being maintained at full operating temperature when cold workpieces capable of absorbing a large amount of energy are introduced into the retort.

A further object of the invention is to uniquely construct the exit end of the retort so that the workpieces continuously dribble into the quench tank rather than being dumped therein in batches.

Still another object of the invention is to provide a retort in which the treating gas is pre-heated by flowing along the outside of the retort and then flows reversely through the retort to treat the workpieces, the retort being characterized by the absence of a gas seal at the exit end of the retort.

The invention also resides in periodically interrupting the induced flow of current in the retort in order to prevent the workpieces from magnetically clinging to one another and to the wall of the retort.

These and other objects and advantages of the invention will become more apparent from the following detailed description when taken in conjunction with the accompanying drawings.

DETAILED DESCRIPTION OF THE PREFERRED EMBODIMENT

Figure 1:
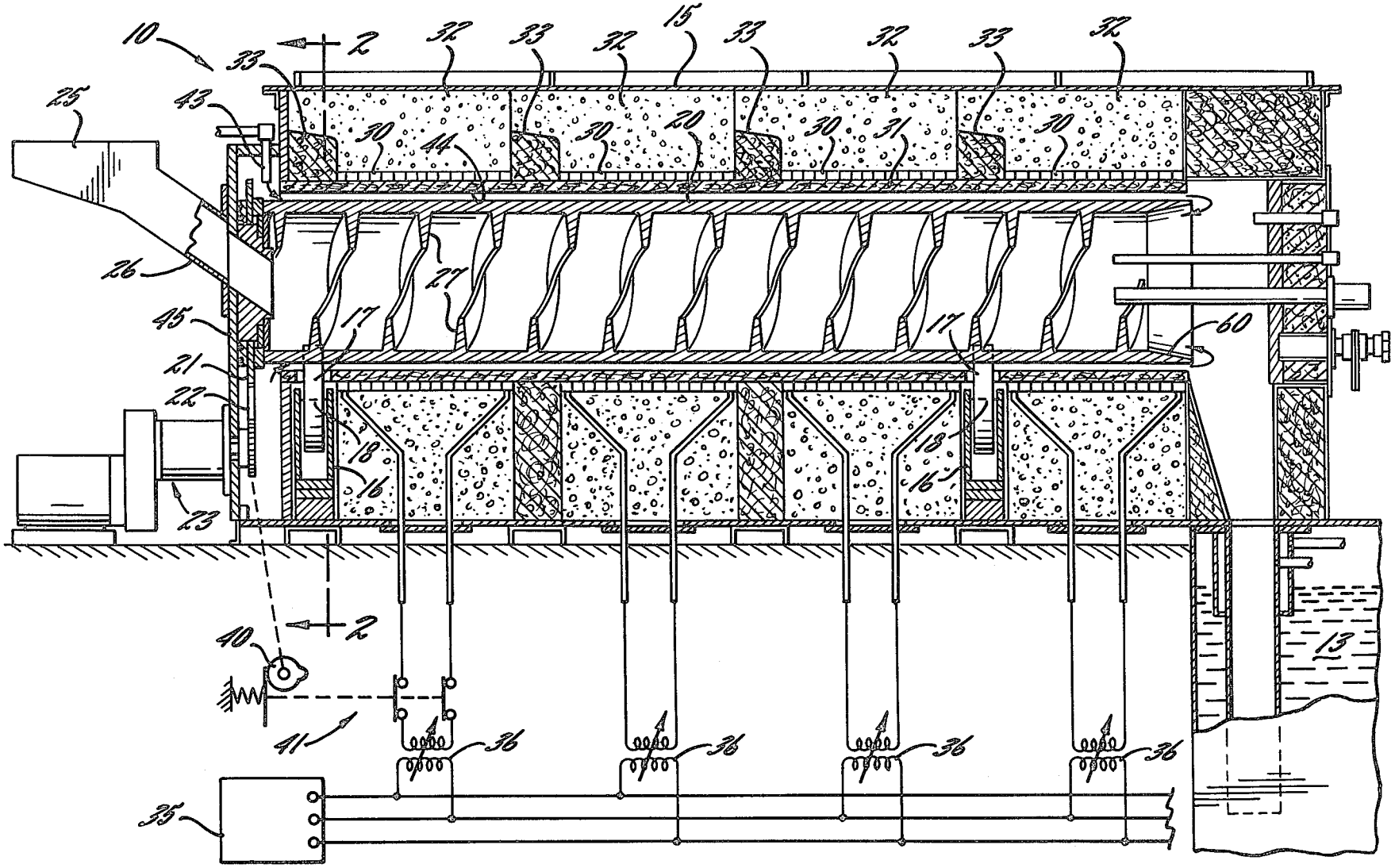
FIG. 1 is a longitudinal cross-section taken vertically through a new and improved rotary retort heat treating furnace incorporating the unique features of the present invention.

As shown in the drawings for purposes of illustration, the invention is embodied in a heat treating furnace 10 of the rotary retort type. Such a furnace is typically used to heat small particulate workpieces 11 (FIG. 4) such as screws or ball bearings to high temperatures (e.g., 2,000 degrees F.) in the presence of a non-oxidizing gas. The workpieces are loaded loose into the furnace from one end thereof and are advanced toward the other end while being continuously tumbled within the furnace so as to fully expose the surfaces of all of the workpieces to the heat and the gas and thereby promote uniform heat treating of the workpieces. Upon being discharged from the furnace, the workpieces usually are delivered to a quenching bath 13 (FIG. 1) of oil or water.

In the present instance, the furnace 10 includes an enclosure defined in part by an outer steel jacket 15 which is of rectangular cross-section. Supported on the bottom wall of the jacket 15 are front and rear pairs of mounting brackets 16 (FIG. 2). Each mounting bracket supports a roller 17 for rotation about a horizontal axis 18. The rollers, in turn, support a generally horizontal tubular retort 20 to rotate about its longitudinal axis. A sprocket 21 (FIG. 1) is secured to the forward end of the retort and is connected by a chain 22 to a drive mechanism indicated generally by the reference numeral 23 and operable to rotate the retort about its axis at a speed which may be selectively adjusted.

A storage hopper 25 (FIG. 1) for the workpieces 11 is located at the forward end of the furnace 10 and includes a chute 26 which leads into the upstream or inlet end of the retort 20. Disposed within and secured to the retort is a substantially helical conveyor flight 27 which extends around and along the inner side of the retort. When the retort is rotated, the flight advances the workpieces from the inlet end of the retort to the exit end thereof with an auger-like action. As the workpieces are advanced, they tend to move up the sides of the retort and then fall back to the bottom of the retort. As a result, the workpieces are continuously tumbled during their advance.

In accordance with the primary aspect of the present invention, the rotary retort 20 of the heat treating furnace 10 is heated by inducing electrical current to flow in the retort. By virtue of the inductive heating, heat is generated in the retort itself rather than being transferred through the retort by conduction. As will become more apparent subsequently, several advantages are obtained as a result of inductively heating the retort.

Figure 2:
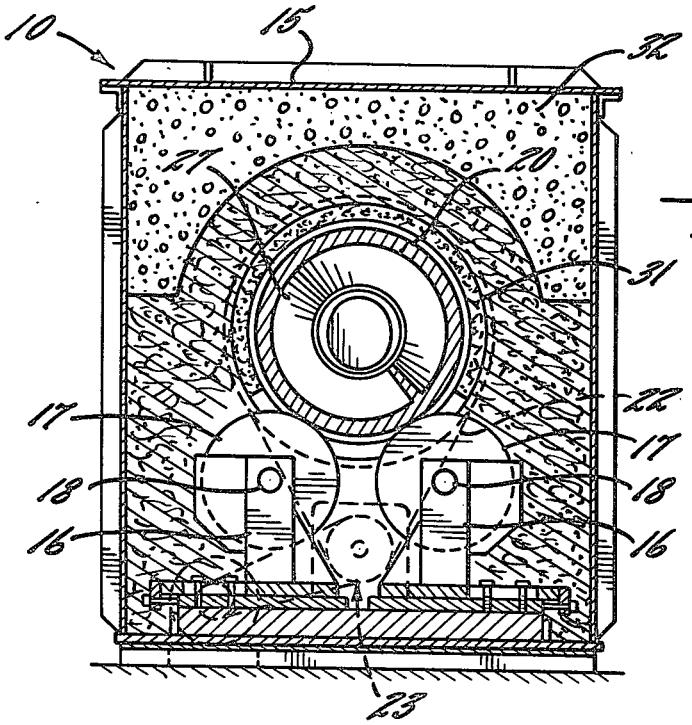
FIG. 2 is a cross-sectional view taken substantially along the line 2—2 of FIG. 1.

More specifically, the retort 20 herein is made of an electrically conductive and heat resistant material such as a nickel-chromium-steel alloy and is inductively heated by several (e.g., four) multiple turn windings or coils 30 (FIG. 1). Each coil is lined with an insulating sleeve 31 of fiber wool or felt which is disposed in radially spaced surrounding relationship with the retort. The space between the coils and the shell 15 of the furnace is filled with blocks 32 of rigid insulating material such as concrete. The four coils are spaced from one another along the retort and are separated from one another by rings 33 of fibrous insulating material.

The induction coils 30 are standardized solenoid inductors although other types of inductors such as linear inductors or transflux inductors could be used, either alone or in combination with the solenoid inductors. The inductors are connected across a source 35 of three-phase alternating current voltage and, when the inductors are excited by the voltage source, current is induced to flow in the retort 20 and acts to directly heat the retort. By regulating the power supplied to the different coils with, for example, variable transformers 36, different temperatures may be maintained along the length of the retort. The upstream zones preferably are held at a higher temperature then the downstream zones in order to quickly bring the cold workpieces up to the desired temperature. Preferably, the flow of current to at least the upstream coil 30 is periodically interrupted for an interval such as one second in order to periodically collapse the magnetic field in the upstream end portion of the retort and prevent the workpieces 11 from magnetically clinging to one another and to the inner side of the retort. As a result, the workpieces tumble in the upstream end portion of the retort rather than rotating upwardly with the retort. After the workpieces have been heated to a certain temperature (e.g., 1300 degrees F.) they lose their magnetic properties and no longer tend to cling or clump so that it is not necessary to collapse the magnetic field in the downstream portion of the retort in order to permit the workpieces to tumble freely. The frequency of the current interruptions in the upstream coil 30 is changed directly in proportion to the feed rate of the workpieces, the feed rate being directly proportional to the angular velocity. For this purpose, a cam 40 (FIG. 1) may be rotated by the output of the drive mechanism 23 and may periodically open and close a switch 41 in the energization path of the upstream coil 30.

By virtue of the induction coils 30, heat is generated directly in the retort 20 itself and need not be conducted through the wall of the retort as is the case when the retort is heated by gas-fired burners or the like. As a result, the workpieces 11 can be heated to a high temperature without heating the retort to a significantly higher temperature. Also, the temperature differential between the inner and outer sides of the retort is virtually zero and thus the thermal stress in the retort is substantially reduced. Because of the uniform heating within the retort wall itself, the wall can be comparatively thick and can be supported by rollers 17 positioned along the length of the retort as often as necessary to prevent the retort from sagging under heavy loads. This enables the use of a longer retort than is possible with gas-fired furnaces and enables the diameter of the retort to be reduced while still maintaining a high production rate.

Heating of the retort 20 by the induction coils 30 advantageously enables the heat treating gas to be preheated by flowing along the outer side of the retort, the gas then flowing directly across the workpieces 11 in a direction opposite to the direction of advance of the workpieces. As shown in FIG. 1, gas is admitted into the furnace 10 through an inlet pipe 43 located at the forward end of the furnace. Such gas flows into the annular space 44 between the retort 20 and the sleeve 31 and is heated by the hot retort upon flowing downstream along the outer side of the retort. The gas then flows into the exit end of the retort, flows reversely or upstream across the workpieces 11 and is discharged through an outlet (not shown) in the chute 26. Accordingly, the gas is heated as it flows downstream and then passes upstream against the flow of the workpieces so as to contact the workpieces with an effective scrubbing action.

Figure 3:
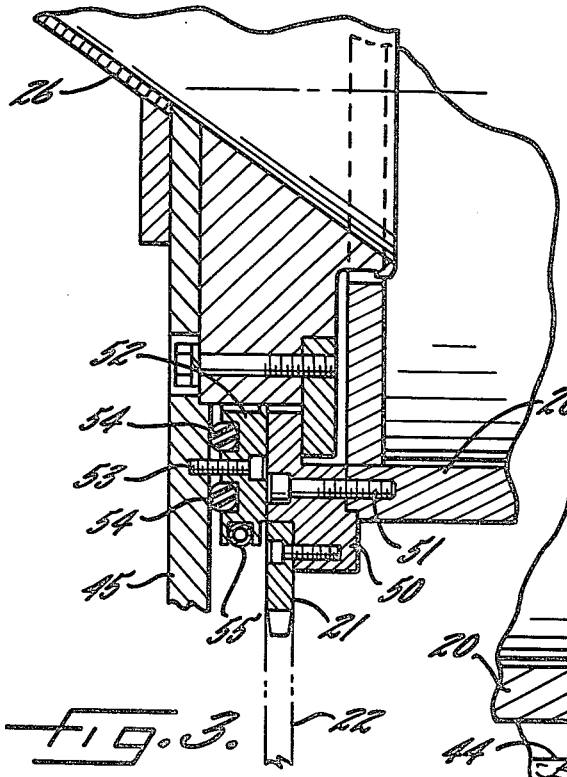
FIG. 3 is an enlarged view of a portion of the inlet end portion of the retort shown in FIG. 1.

To keep the treating gas in the shell 15 and to prevent the gas from flowing into the upstream end of the retort 20, a rotary seal is provided between the upstream end of the retort and a wall 45 (FIG. 3) which supports the chute 26. Herein, the seal is formed by a sealing ring 50 (FIG. 3) which forms a mounting hub for the sprocket 21 and which is fastened to the forward end of the retort by screws 51. The sealing ring 50 is disposed in face-to-face engagement with a second ring 52 fastened by screws 53 to the end wall 45 and sealed thereto by O-rings 54. The sealing ring 52 and the O-rings 54 are cooled by water which is circulated through an annular tube 55, the latter being secured to and extending around the sealing ring 52.

Because there is no combustion gas in the furnace 10, there is no need to provide a rotary gas seal between the exit end of the retort 20 and the downstream end wall of the furnace. This not only avoids the expense of such a seal but also allows the extreme downstream end of the retort to be heated to a high temperature since there is no seal to be affected by the heat. Thus, the induction coils 30 may encircle the extreme downstream end of the retort 20 so as to effect heating of the workpieces 11 up to the very point where the workpieces are discharged from the retort.

Figure 4:
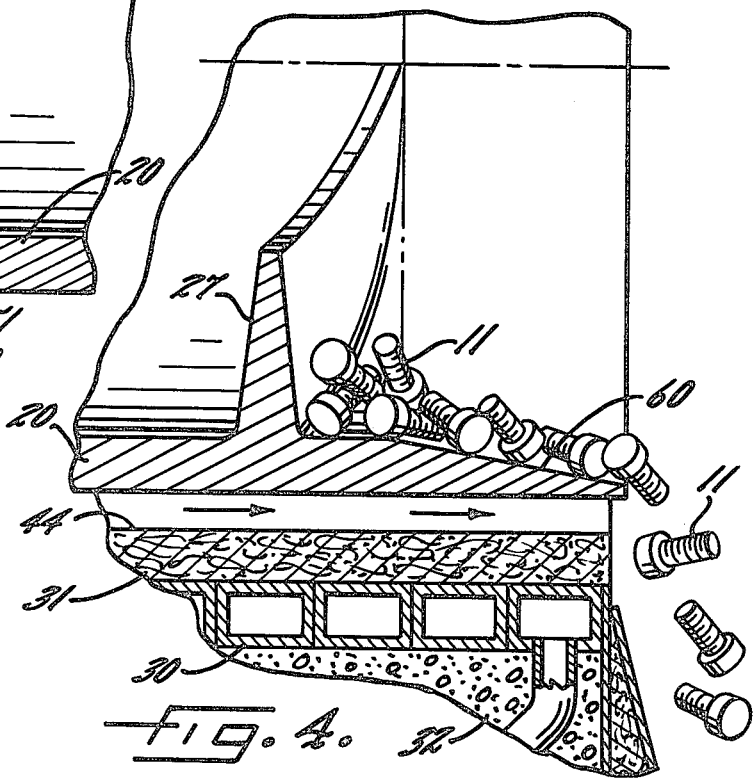
FIG. 4 is an enlarged view of the exit end portion of the retort shown in FIG. 1.

Another feature of the invention resides in the construction of the exit end of the retort 20 to permit the workpieces 11 to dribble continuously out of the retort and into the quench bath 13 rather than being dumped into the bath in batches. As shown in FIG. 4, the helical flight 27 terminates short of the extreme downstream end of the retort and, if the workpieces were permitted to drop from the retort at the termination of the flight, batches of workpieces would intermittently fall from the retort and would splash into and rapidly heat the quench bath. In carrying out the invention, a rotary distributor 60 (FIG. 4) is formed on the downstream end of the retort to accumulate the batches and to cause the workpieces to dribble continuously from the retort. Herein, the distributor is in the form of an annular internal frustum formed on the exit end of the retort downstream of the flight 27. The frustum 60 gradually flares outwardly upon progressing in a downstream direction and forms a ramp which causes the workpieces to gravitate out of the retort. As a result of the frustum 60, the batches of workpieces intermittently discharged from the flight 27 are momentarily collected and then are gradually and continuously dribbled into the quench bath 13.

I claim:

1. A rotary heat treating furnace comprising a tubular retort made of electrically conductive and heat resistant material and having an upstream inlet end and a downstream exit end, means for rotating said retort about its own axis, stationary upstream and downstream electric coils surrounding said retort and operable when excited to induce a flow of current in said retort thereby to inductively heat said retort, a source of alternating current voltage for exciting said coils, means for introducing a flow of particulate workpieces into the inlet end of said retort, a substantially helical flight secured to and extending around and along the inner wall of said retort and operable to advance the workpieces from the inlet end of the retort toward the exit end thereof in response to rotation of the retort, and means for periodically and automatically interrupting the flow of current between said voltage source and the most upstream one of said coils and for causing the frequency of the current interruptions to be directly proportional to the angular velocity of said retort whereby the magnetic field created by said one coil is periodically collapsed to prevent said workpieces from magnetically clinging to the upstream end portion of said retort.

2. A furnace as defined in claim 1 in which the downstream end of said flight terminates short of the exit end of said retort, the exit end portion of said retort being located adjacent the downstream end of said flight and being defined by an internal annular frustum which flares outwardly upon progressing toward the exit end of said retort.

3. A furnace as defined in claim 1 further including an enclosure surrounding said retort and spaced outwardly therefrom, means for causing a quantity of treating gas to flow along the outer side of said retort from the inlet end portion of the retort to the exit end thereof and then to flow reversely along the inner side of said retort.

4. A furnace as defined in claim 3 further including means sealing the inlet end of said retort to said enclosure to prevent the flow of gas between the inlet end and the enclosure while permitting rotation of said retort relative to said enclosure, the exit end of said retort being free of a rotary seal with said enclosure.

5. A rotary heat treating furnace comprising a tubular retort made of electrically conductive and heat resistant material and having an inlet end and an exit end, means for rotating said retort about its own axis, stationary electric coils surrounding said retort and operable when excited to induce a flow of current in said retort and thereby inductively heat said retort, a source of alternating current voltage for exciting said coils, means for introducing a flow of particulate workpieces into the inlet end of said retort, means within said retort for advancing said workpieces from the inlet end of the retort toward the exit end thereof, an enclosure surrounding said retort and spaced outwardly therefrom, means for causing a quantity of treating gas to flow along the outer side of said retort from the inlet end portion of the retort to the exit end thereof and then to flow reversely along the inner side of said retort, means sealing the inlet end of said retort to said enclosure to prevent the flow of gas between the inlet end and the enclosure while permitting rotation of said retort relative to said enclosure, the exit end of said retort being free of a rotary seal with said enclosure.

6. A rotary heat treating furnace comprising a generally horizontal tubular retort made of electrically conductive and heat resistant material and having an upstream inlet end and a downstream exit end, sets of rollers spaced along the bottom of said retort and supporting the retort for rotation about its own axis, means for continuously rotating said retort in one direction about said axis, stationary upstream and downstream electric coils surrounding said retort and operable when excited to induce a flow of current in said retort thereby to inductively heat the retort, a source of alternating current voltage for exciting said coils, means for introducing a flow of particulate workpieces into the inlet end of said retort, a substantially helical flight secured to and extending around and along the inner wall of said retort and operable to advance the workpieces from the inlet end of the retort toward the exit end thereof in response to rotation of the retort, the downstream end of said flight terminating short of the exit end of said retort, the exit end portion of said retort being located adjacent the downstream end of said flight and being defined by an internal annular frustum which flares outwardly upon progressing toward the exit end of the retort, and means for periodically and automatically interrupting the flow of current between said voltage source and the most upstream one of said coils and for causing the frequency of the current interruptions to be directly proportional to the angular velocity of said retort whereby the magnetic field created by said one coil is periodically collapsed to prevent said workpieces from magnetically clinging to the upstream end portion of said retort.

* * * * *